US006079956A

United States Patent [19]

Maliszewski

[11] Patent Number: 6,079,956

[45] Date of Patent: Jun. 27, 2000

[54] MULTI-STAGE HYDRAULIC PUMP

[75] Inventor: John L. Maliszewski, Sierra Madre, Calif.

[73] Assignee: Trench Plate Rental Co., Inc., Downey, Calif.

[21] Appl. No.: 09/048,964

[22] Filed: Mar. 26, 1998

[51] Int. Cl.[7] ..... F04B 3/00

[52] U.S. Cl. ..... 417/252; 417/244

[58] Field of Search ..... 417/62, 216, 244–5, 417/251–2

[56] References Cited

U.S. PATENT DOCUMENTS 3,628,567 12/1971 Bender et al. .
3,747,473 7/1973 Bach et al. .
3,787,147 1/1974 McClocklin et al. .
3,896,620 7/1975 Flory .
3,908,701 9/1975 Dawawala .
4,287,813 9/1981 Chatterjea et al. .
4,850,828 7/1989 Yonezawa ..... 417/252
5,207,726 5/1993 Rathweg .
5,575,627 11/1996 Vairin et al. ..... 417/252

*Primary Examiner*—Thomas N. Moulis
*Attorney, Agent, or Firm*—Sanford Astor

[57] ABSTRACT

A multi-stage manual hydraulic pump comprising a plurality of cylinders in tandem. A block holds each cylinder assembly. One or more cylinders are the high volume stage, one or more cylinders are the medium volume stage and the final cylinders are the low volume, high pressure stage. The pump utilizes check valves built into flow tubes that control the direction of fluid. A spring and piston in each high volume block automatically turns off the vacuum and flow of fluid to each cylinder at a designated pressure. At the point of highest pressure only the smallest cylinder or cylinders are pumping fluid, where the effort expended is significantly reduced.

10 Claims, 5 Drawing Sheets

MULTI-STAGE HYDRAULIC PUMP

BACKGROUND OF THE INVENTION

Manual hydraulic pumps are used in many applications in the field where electrical or other power operated pumps are not practical or economical. One such usage is in the installation of shoring which is the support structure which holds the sides of trenches during construction. The support structure consists of vertical support rails connected together by horizontal cylinders into which fluid, usually water mixed with a soluble oil or other lubricating fluid, is pumped until a desired pressure is reached, to press the vertical rails against the sides of the trench. A series of these support rail structures may be placed along the length of the trench. Each rail support structure must be individually filled with fluid and brought to a pressure to properly press against the sides of the trench to hold it in place and prevent its collapse.

This filling of the horizontal cylinders to the proper pressure is now most often done by a single cylinder manual pump submerged in a container of fluid. A quick connect coupling attaches a hose from the output of the pump to the horizontal cylinder. The pump handle is then pumped to bring the fluid from the container into the horizontal cylinder. Until the horizontal cylinder is filled with fluid the manual pumping is quite easy. However, when the vertical rails make contact with the trench walls, the manual pumping becomes very difficult. A pressure of from 700 up to about 4000 psi may be required, depending upon the nature of the soil, to properly put the shoring in place. It may be very difficult, for one individual to pump the fluid to the pressure required. A need exists for a pump which allows an individual operator to easily fill the fluid in the shoring to the required pressure using a small manual pump which fits into the container of fluid which is to be pumped into the shoring structure.

SUMMARY OF THE INVENTION

This invention comprises a multi-stage manual hydraulic pump comprising a plurality of cylinders, pistons, and blocks in tandem. A block holds each cylinder assembly. One or more cylinders comprise the high volume stage, one or more cylinders comprise the medium volume stage and one or more cylinders comprise the low volume, high pressure stage. The pump may comprise as few as two stages or as many as is required to reach the desired pressure. The pump utilizes check valves built into flow tubes that control the direction of fluid. A spring and piston in each higher volume block automatically turns off the vacuum and flow of fluid to each higher volume cylinder at a designated pressure of pounds per square inch (psi). At the point of highest pressure only the smallest cylinder or cylinders are pumping fluid, where the effort expended is significantly reduced and the operator may effortlessly pump the amount of fluid required to reach the desired pressure in a very short span of time.

The uniqueness of the pump of this invention lies in the ease and quickness that the pump reaches its designated psi and required volume of fluid. Using a spring and piston in each higher volume block that automatically turns off the vacuum and flow of fluid to each higher volume cylinder at a designated psi, allows each cylinder to switch from pumping fluid to pumping air. Spring tension and piston diameter are sized for each cylinder to minimize the amount of work performed by the operator. The highest volume cylinder assembly reaches its designated low pressure and automatically turns off first, the succeeding lower volume cylinders continue to pump fluid.

In turn the next highest volume cylinders automatically turn off when the desired next higher pressure is reached. Thus, at the point of highest pressure, only the highest pressure, smallest volume cylinder or cylinders are pumping fluid. Because the diameter of the high pressure cylinders is relatively small, the effort expended is reduced significantly. As the pressure increases, the pump becomes increasingly easier to operate. Thus, the operation of the pump of this invention at high pressure is the opposite of what is found in existing manual pumps.

OBJECTS OF THE INVENTION

Accordingly, several objects and advantages of the invention are as follows:

It is an object of the present invention to provide a manual hydraulic pump which allows an individual to easily pump fluid to a high pressure.

Another object of the invention is to provide a simple and small manual hydraulic pump in which a single operator can pump fluid into shoring to a preselected high pressure.

Yet another object of the invention is to provide a simple, small and inexpensive manual hydraulic pump which fits into a container of liquid used to hold shoring in place in construction trenches.

DETAILED DESCRIPTION OF THE INVENTION

Figure 1:
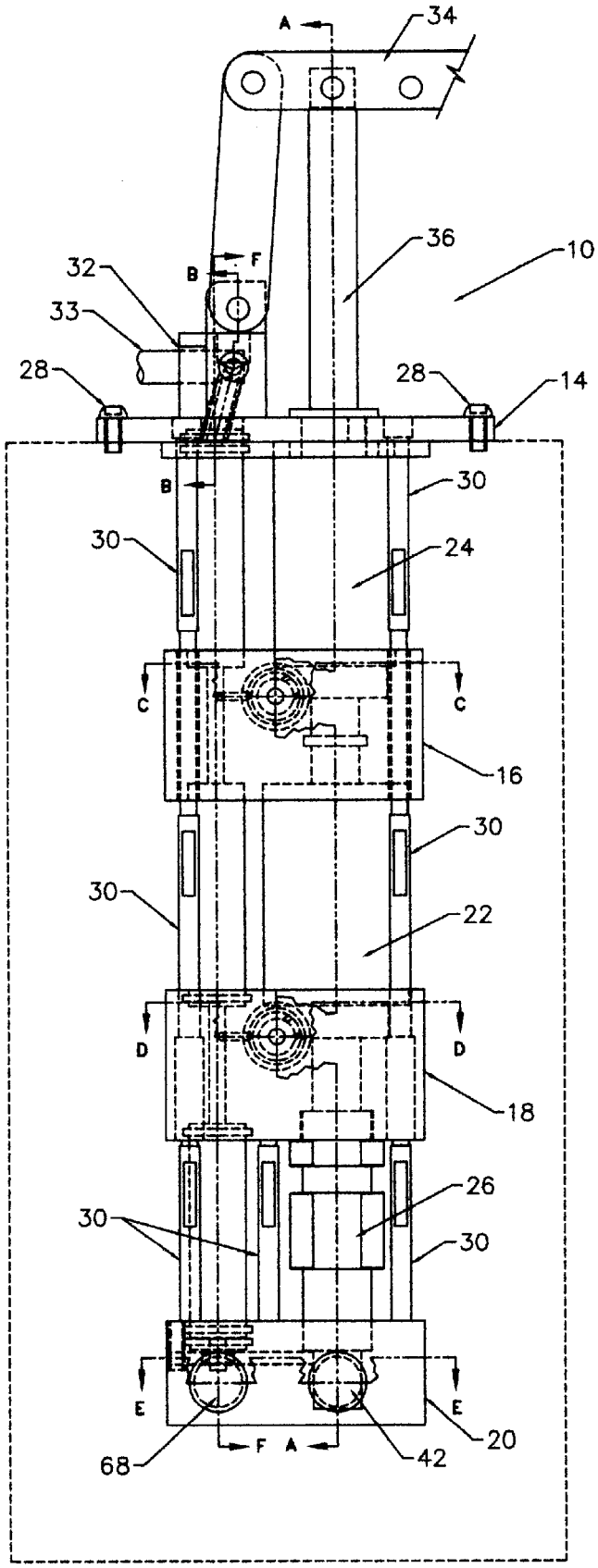
FIG. 1 is a left side view of the pump of this invention.
Figure 2:
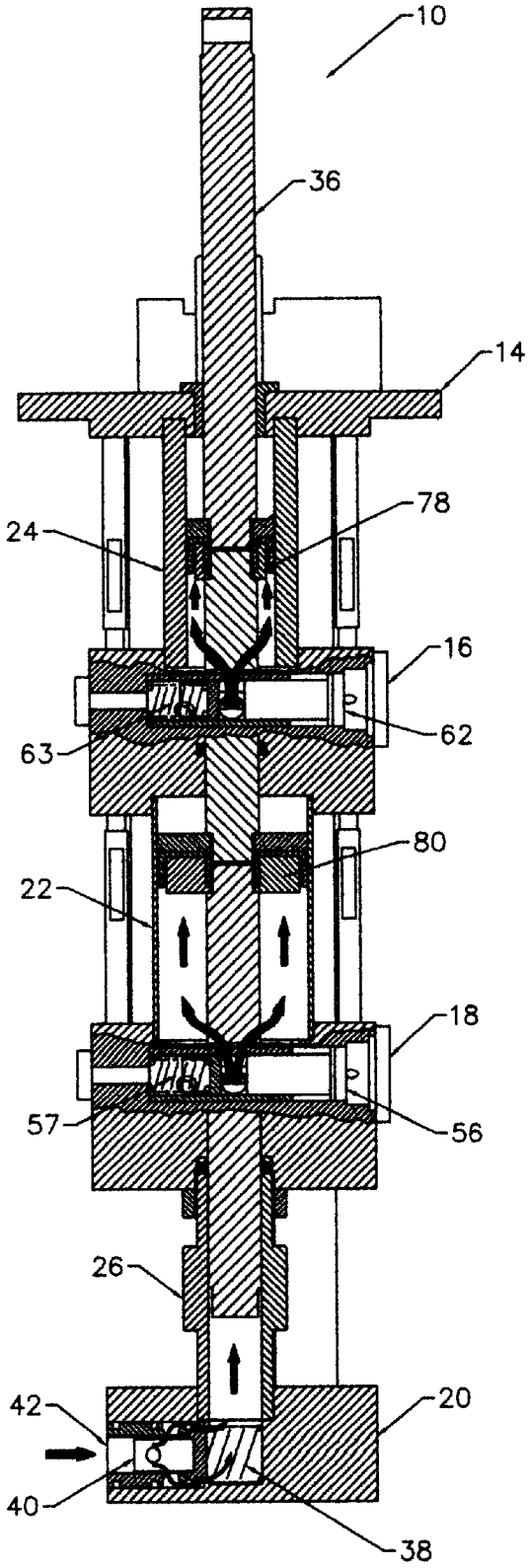
FIG. 2 is a cross-section taken on lines A—A of FIG. 1.
Figure 3:
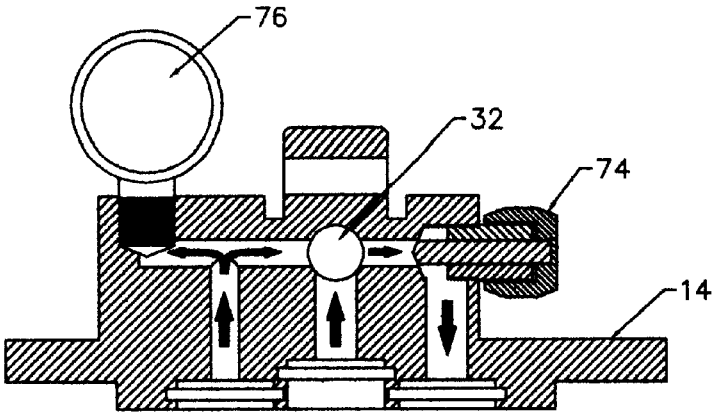
FIG. 3 is a cross-section taken on lines B—B of FIG. 1.
Figure 4:
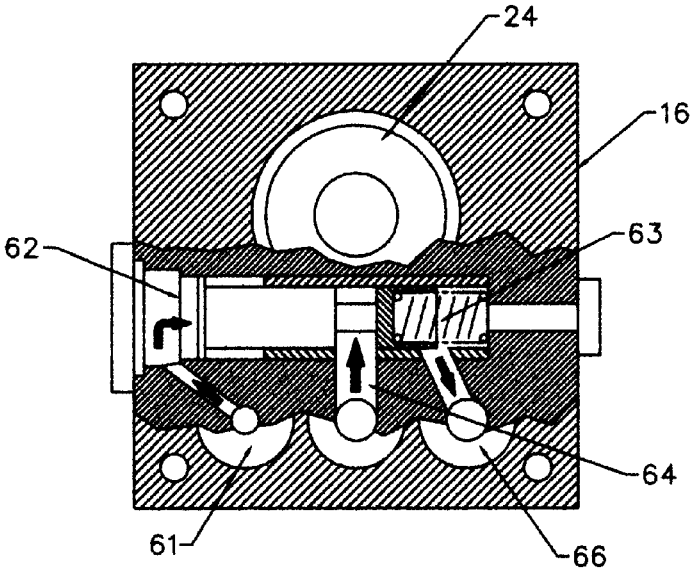
FIG. 4 is a cross-section taken on lines C—C of FIG. 1.
Figure 5:
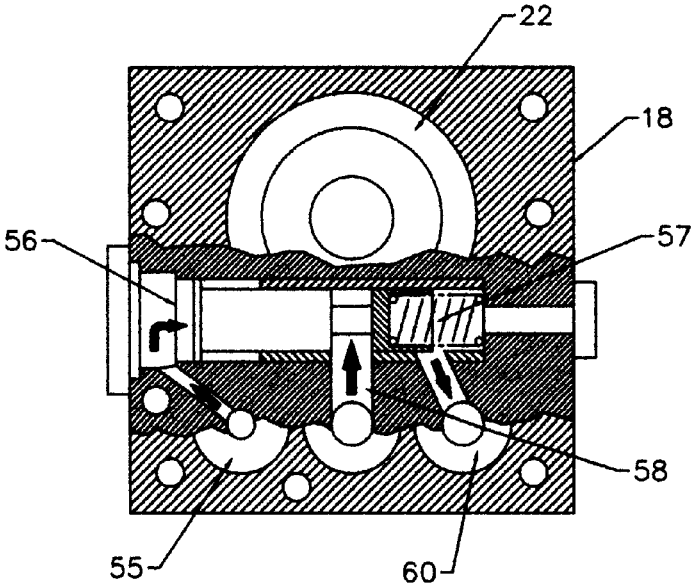
FIG. 5 is a cross-section taken on lines D—D of FIG. 1.

Referring now to the drawings there is shown the multi-stage pump 10 of this invention placed in a vented hydraulic fluid container 12. The standard fluid container in use today in the shoring industry, holds about 5 to 7 gallons of fluid. The pump, as shown in this embodiment, comprises four blocks, upper block 14, second stage block 16, first stage block 18, and input block 20. The pump as shown has three stages but could have from two to as many stages as are required to reach the desired volume and pressure. Blocks 14, 16, 18, and 20 are held together by a plurality of bolts 30.

The pump also comprises three cyliders, the first stage or high volume cylinder 22, the second stage or medium volume cylinder 24, and the high pressure, low volume cylinder 26.

The pump, for best operation, is bolted, by a plurality of bolts 28, to the top of container 12 and container 12 is filled with a fluid such as water containing hydraulic oil, or other fluid, submerging the pump partially in the fluid. A hydraulic hose 33 is attached, at one end to the output port 32 of the pump and at the opposite end to the working shore. The description of the pump will be made with reference to its use in expanding and pressurizing shoring, although the pump could obviously be used for other purposes which require a fluid to be pumped to a high pressure.

When handle 34 is lifted (up-stroke) piston 36 is pulled upward, creating a vacuum in the system, exerting a compression force on spring 38 of check valve 40 in intake port 42 located in block 20, opening check valve 40, allowing fluid to be sucked into high pressure cylinder 26 and through communication line 43 up tubes 48, 46 and 44. Fluid then passes into blocks 18 and 16 through ports 55 and 61 and against pistons 56 and 62.

Also, on the up-stroke of piston 36, which has piston head 78 in cylinder 24 and piston head 80 in cylinder 22, fluid similarly also enters via entry port 68, through check valve 39 having spring 41, to tubes 54, 52, and 50 and through ports 58 and 64 into cylinders 22 and 24. When the up-stroke of piston 36 reaches its highest point, all of the cylinders 22, 24 and 26 are then filled with fluid. In addition, tubes 44, 46 and 48 as well as tubes 50, 52 and 54 are filled with fluid.

On the down-stroke, fluid is pushed from the cylinders back through ports 58 and 64, and due to check valves 59, 61, 63 and 65, up into block 14 and out output port 32. Check valves 59, 61, 63, and 65 prevent fluid from passing back down the tubes and cylinders. Check valves 40 and 39 similarly prevent fluid from passing back through ports 42 and 68.

Figure 7:
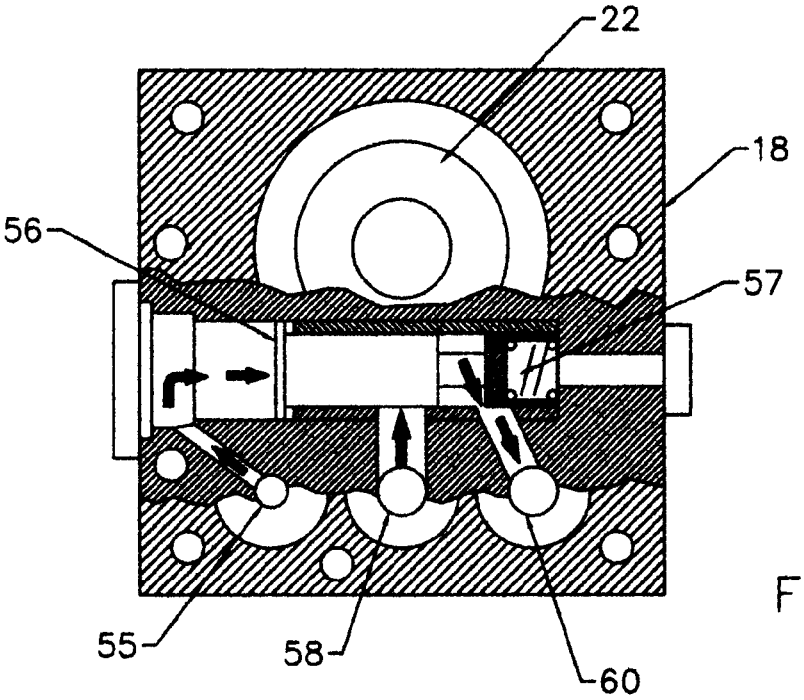
FIG. 7 is a cross-section taken on lines D—D of FIG. 1, after piston displacement.
Figure 8:
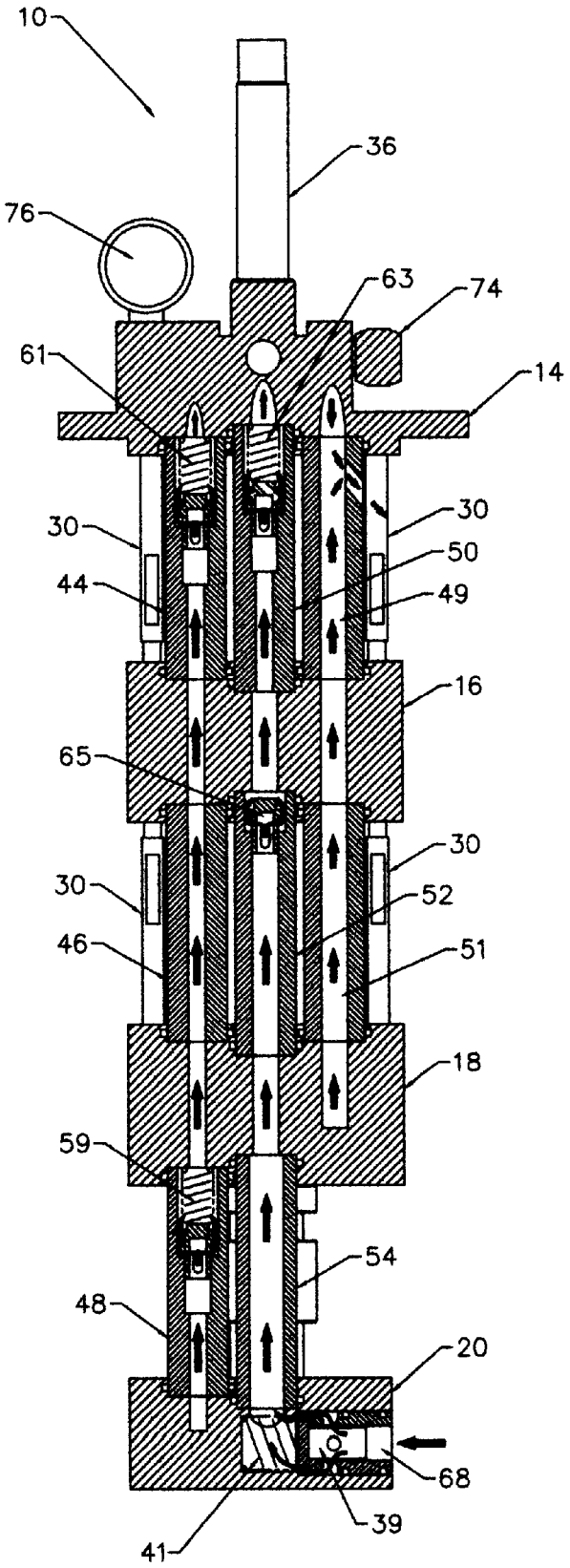
FIG. 8 is a cross-section taken on lines F—F of FIG. 1.

In the first stage of the manual pumping process all three cylinders 22, 24 and 26 are pumping high volumes of fluid into the shore to expand it as fast as possible, with the least amount of strokes. At this time the horizontal tubing of the shore is simply expanding quickly to meet the walls of the trench, without any resistance. Once the shore reaches the walls of the trench, the pressure inside of the pump cylinders begins to build up. When the pressure reaches a preset level, such as 300 psi, as shown in FIG. 7, the first stage pressure control piston 56 located inside of block 18 displaces against spring 57 to close input port 58 preventing all fluid from entering into high volume cylinder 22 and opens exhaust pressure release port 60 to exhaust the fluid into exhaust tube 51, thus disabling high volume cylinder 22. Exhaust port 60 will remain open until pressure is below the predetermined spring pressure. After all fluid has been exhausted through exhaust tube 51, only air will be pumped into and out of cylinder 22 on succeeding strokes.

With the first stage complete and cylinder 22 disabled, cylinders 24 and 26 continue to pump fluid. As the pump handle continues to be actuated, cylinders 24 and 26 continue to increase the system pressure until the pressure reaches another level, such as 1,200 psi. When that pressure is reached, similarly to the process shown in FIG. 7, stage pressure release piston 62 in block 16 is displaced against spring 63 to close input port 64 preventing all fluid from entering into medium volume cylinder 24 and opens exhaust pressure release port 66 to exhaust the fluid into exhaust tube 49, thus disabling medium volume cylinder 24. This completes the second stage.

The third and final stage comprises low volume, high pressure cylinder 26 continuing to pump fluid as the operator continues to pump handle 34, increasing the pressure of the system from 1,200 psi up to the required final pressure desired, which can be as high as about 4000 psi.

The difference in volume of the three stages of the pump are dependent on the exact design of the pump, however, in the embodiment shown, the high volume cylinder 22 is from about 5 cubic inches to about 7 cubic inches, the medium volume cylinder 24 from about 1 cubic inch to about 2 cubic inches and the high pressure cylinder 26 from about 0.5 cubic inches to about 1 cubic inch. The volume stated is measured by the total volume of the cylinder less the volume taken up by piston 36 located in cylinders 22 and 24 only.

Figure 6:
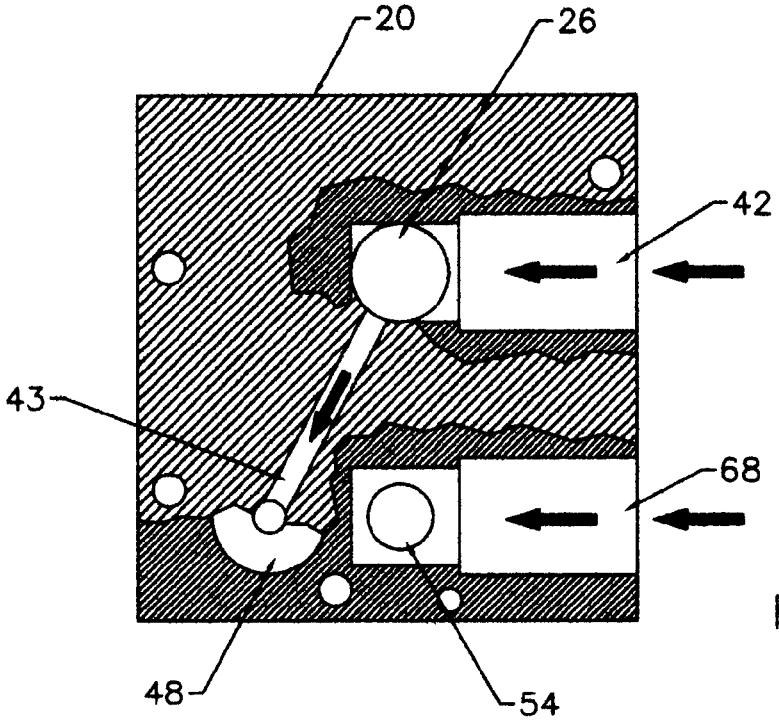
FIG. 6 is a cross-section taken on lines E—E of FIG. 1.

Referring to FIG. 6 there is shown block 20 with input port 68 running to high volume tubes 54, 52, and 50 and input port 42 running to cylinder 26 only and through communication line 43 to tubes 48, 46, and 44. Inport ports 42 and 68 may be set in the vertical position rather than the horizontal position as shown. All input ports may contain filters to filter out unwanted impurities that might negatively affect the operation of the pump.

When it is time to remove the working shore from the trench, the pressure inside the horizontal shore cylinders is released by attaching the pump 10, then the pressure in the pump system is released allowing the shore to retract. To accomplish this an exhaust valve 74 located on the top of block 14 is opened to allow the fluid to flow through exhaust tubes 49 and 51 back into container 12. Pressure gauge 76 is provided on block 14 to constantly measure the pressure in the pump in order to achieve the preselected desired pressure in the shore.

The shore equipment must be inserted in the trench and brought to a specific preselected pressure. Too little pressure or too much pressure both will have a negative effect on maintaining the sides of the trench in a safe condition.

Having thus described the invention,

I claim:

1. A multi-stage manual hydraulic pump having a pump handle, adapted to pump fluid to a high pressure, comprising a plurality of cylinders of decreasing volume, each cylinder having a cylinder piston, all of said cylinder pistons mechanically connected together, and mechanically connected to the pump handle, each of the higher volume cylinders having a block containing means to disable each higher volume cylinder in succession as pressure within the pump increases, by preventing the flow of fluid to the cylinder at a designated pressure being reached, the lowest volume cylinder reaching the highest pressure, further comprising two fluid inlet ports, the first port carrying fluid to the low volume, high pressure cylinder and to a set of flow tubes leading to each of the cylinder blocks and the second port carrying fluid to a set of flow tubes leading to each of the higher volume cylinders.

2. The pump of claim 1 in which the means to disable each cylinder comprises a spring and piston adapted to prevent the flow of fluid to the cylinder at a designated pressure being reached in the pump.

3. The pump of claim 1 further comprising check valves in the flow tubes and check valves in each of the higher volume cylinders to control the direction of flow of the fluid.

4. A three-stage manual hydraulic pump having a pump handle, adapted to pump fluid to a high pressure, comprising a high volume cylinder, a medium volume cylinder and a low volume, high pressure cylinder, each cylinder having a cylinder piston, all of said cylinder pistons mechanically connected together, and mechanically connected to the pump handle, the high volume and medium volume cylinders having a block containing means to disable the cylinder at a preset pressure, the lowest volume cylinder reaching the highest pressure, said disabling means comprising a spring and piston adapted to prevent the flow of fluid to the cylinder at the preset pressure being reached, further comprising two fluid inlet ports, the first port carrying fluid to the low volume, high pressure cylinder and to a set of flow tubes leading to each of the cylinder blocks and the second port carrying fluid to a set of flow tubes leading to each of the higher volume cylinders.

5. The pump of claim 4 further comprising check valves in the flow tubes, check valves in the higher volume cylinders and check valves in the inlet ports to control the direction of flow of the fluid.

6. A multi-stage manual hydraulic pump having a pump handle adapted to pump fluid to a high pressure in trench shoring, comprising a plurality of cylinders of decreasing volume, each cylinder having a cylinder piston, all of said cylinder pistons mechanically connected together, and mechanically connected to the pump handle, each of the higher volume cylinders having a block containing means to disable each higher volume cylinder at succeeding preset higher pressures by preventing the flow of fluid to the cylinder at the designated pressure being reached, the lowest volume cylinder reaching the highest pressure, said disabling means comprising a spring and piston adapted to prevent the flow of fluid to the cylinder at the preset pressure being reached, further comprising two fluid inlet ports, the first port carrying fluid to the low volume, high pressure cylinder and to a set of flow tubes leading to each of the cylinder blocks and the second port carrying fluid to a set of flow tubes leading to each of the higher volume cylinders, means to connect the pump in a container of fluid, means to connect the fluid output of the pump to the shoring.

7. The pump of claim 6 further comprising check valves in the flow tubes, check valves in higher volume cylinders and check valves in the inlet ports to control the direction of flow of the fluid.

8. The pump of claim 6, 11, or 6 further comprising a pressure gauge to constantly monitor the pressure in the pump.

9. The pump of claims 1, 4, or 6 further comprising filters located in said inlet ports to filter out unwanted impurities.

10. The pump of claims 1, 4, or 6 in which said inlet ports are set in the vertical or horizontal position.

* * * * *